United States Patent [19]

Markle

[11] Patent Number: 4,753,534

[45] Date of Patent: Jun. 28, 1988

[54] MIXING APPARATUS

[75] Inventor: Stephen L. Markle, Rochester, N.Y.

[73] Assignee: General Signal Corp., Rochester, N.Y.

[21] Appl. No.: 55,478

[22] Filed: May 28, 1987

[51] Int. Cl.[4] ..... B01F 15/00

[52] U.S. Cl. ..... 366/279; 366/349; 277/126

[58] Field of Search ..... 366/279, 331, 348, 349; 277/126, 127, 28

[56] References Cited

U.S. PATENT DOCUMENTS

| | | | |
|---|---|---|---|
| 2,638,364 | 5/1953 | Rechtin | 277/9 |
| 3,572,650 | 3/1971 | Kupka | 366/286 |
| 4,383,768 | 5/1983 | Kupka | 366/349 |

FOREIGN PATENT DOCUMENTS

| | | | |
|---|---|---|---|
| 1557104 | 6/1970 | Fed. Rep. of Germany | 366/349 |
| 2363237 | 6/1975 | Fed. Rep. of Germany | 366/349 |

*Primary Examiner*—Harvey C. Hornsby

*Assistant Examiner*—C. M. Reinckens

*Attorney, Agent, or Firm*—M. LuKacher; J. S. Mednick

[57] ABSTRACT

Mixing apparatus having a sealed impeller shaft provided by a seal unit which supports the shaft and to which a motor drive unit may be detachably connected. When the motor drive unit is disconnected, the mixing apparatus may be sterilized, along or together with the vessel containing the material to be mixed and to which the seal unit is attached. The seal unit has a seal assembly with a movable part engageable by a drive shaft in the drive unit when the drive unit is mounted on the seal unit. The movable seal part is biased to move to a position against a mounting plate on which the drive unit is mounted when the drive mounted is removed so as to provide a static seal. When the drive unit is attached to the seal unit, the driven shaft engages the moveable seal unit part and moves it to another position away from the mounting plate, where the seal assembly may freely rotate with the impeller shaft and maintain a dynamic seal.

11 Claims, 3 Drawing Sheets

MIXING APPARATUS

DESCRIPTION

The present invention relates to mixing apparatus, and particularly to mixing apparatus which maintains a vessel containing the material to be mixed in sealed condition.

The invention is especially suitable for use in mixing biologically active materials in processes for producing genetically engineered substances so as to enable the mixing apparatus alone or together with the vessel in which the materials are processed to be sterilized from time to time.

Mixing apparatus has been designed so as to maintain a seal around the impeller shaft when bearings, packings or other seals are to be replaced. Such designs use an auxiliary seal which is seated when the shaft is drawn out of the vessel. Such designs are shown in the following U.S. Pat. Nos.: 2,945,711 issued July 19, 1960; 3,606,260 issued Sept. 20, 1971; 4,383,768 issued May 17, 1983; and 4,384,788 issued May 24, 1983.

The problem of providing a sealed shaft is exacerbated when the mixing apparatus must be sterilized. Sterilization is difficult or impossible because the drive motor and gears, which are connected to the impeller shaft, are either to large to install in an autoclave or other sterilization device or the insulation and windings in the motor or the oil which lubricate the gears cannot readily be sterilized.

It is a feature of the present invention to provide mixing apparatus in which the drive unit, having the motor and gears and associated controls and indicators, can be detached from the apparatus while the impeller shaft remains sealed. A seal is maintained which prevents the leakage of biologically active materials, or any other materials which should not leak from the vessel in which mixing is carried out, both during static conditions when the drive unit is detached and during dynamic conditions when the drive unit is attached so as to enable the impeller shaft to be driven. Thus part of the mixing apparatus coming in contact with the materials can be sterilized from time to time, as may be desired.

It is another feature of the invention to provide improved mixing apparatus which has a sealed impeller shaft, and which may be fabricated using seals, such as mechanical seals, which are commercially available, as well as other commercially available parts, such as the motor and gear box for the drive unit.

Briefly described, mixing apparatus embodying the invention is made up of a seal unit and a motor drive unit. The seal unit contains and mounts the impeller shaft and may be mounted on a vessel into which the impeller shaft and the impellers thereon extend. The vessel contains the material to be processed. The seal unit includes a seal assembly having a stationary part and a moveable part which form a rotary seal. The moveable part is connected to the shaft and is translatable in direction along the axis of the shaft as well as being rotatable with the shaft. The seal unit has a plate on which the drive unit is detachably secured. The mounting plate has a surface on one side thereof (the side which faces the vessel) which defines a first location in the axial direction for the moveable seal assembly part. Spring means in the moveable seal assembly part biases it against the surface of the mounting plate while maintaining the rotary seal surfaces in contact. When the moveable part of the seal assembly is in the first location, a static seal is maintained. The drive unit has a member, which may be a tubular drive shaft which engages the impeller shaft when the drive unit is secured to the mounting plate. This member translates the impeller shaft and the movable sealing assembly part against the bias to a second position where the moveable sealing assembly part is free of the mounting plate and can rotate without restriction. In the second position the rotary seal is maintained and provides a dynamic seal sealing the impeller shaft when it is driven. No auxiliary seals are required and the seal assembly may be a mechanical seal of the type which is commercially available.

The foregoing and other objects, advantages and features of the invention, as well as a presently preferred embodiment thereof, will become more apparent from a reading of the following description in connection with the accompanying drawings in which.

Figure 1:
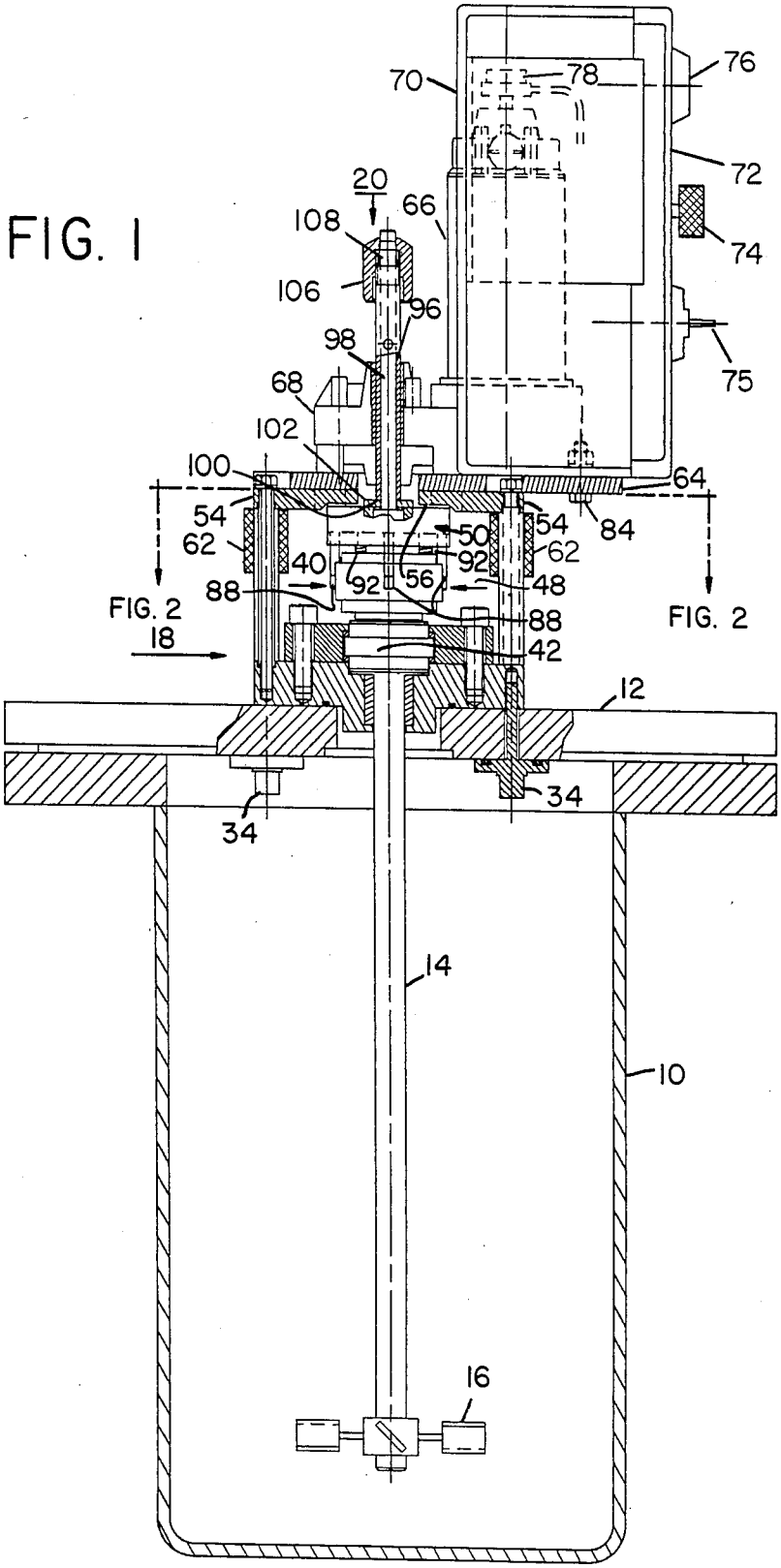
FIG. 1 is an elevational view, in section, the section being taken along the line 1—1 in FIG. 2, of mixing apparatus in accordance with a presently preferred embodiment of the invention.
Figure 2:
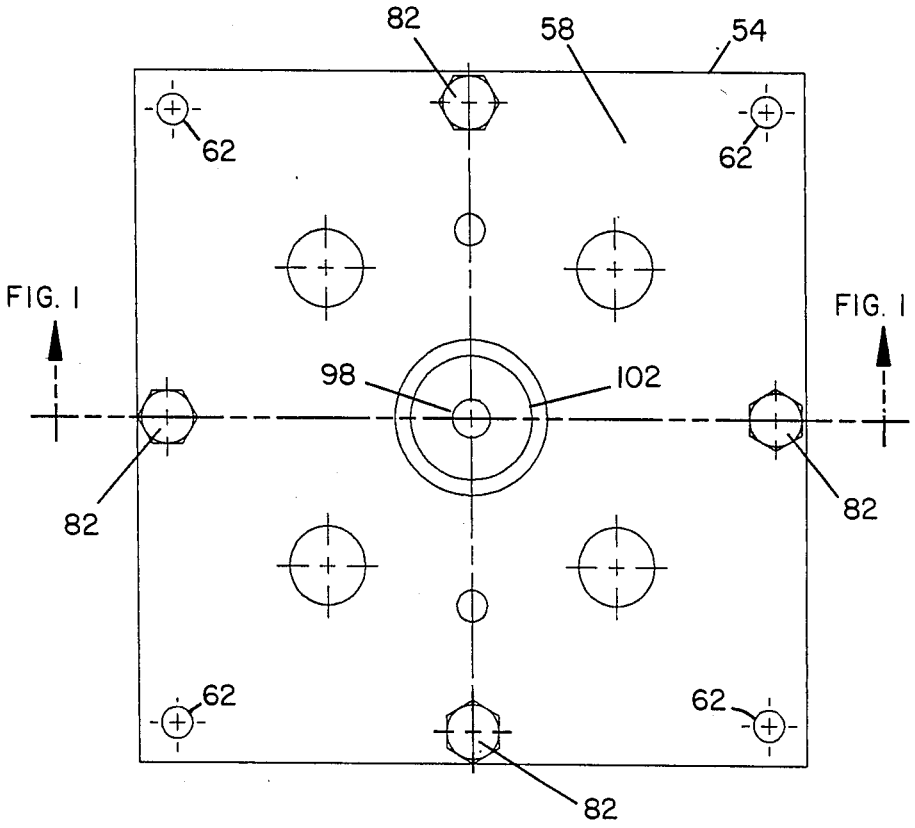
FIG. 2 is a sectional plan view of the apparatus shown in FIG. 1, the section being taken along the line 2—2 in FIG. 1.

Referring to the drawings there is shown a vessel which contains the material to be processed by mixing. The vessel 10 has a cover 12 which closes and seals it. A sealed impeller shaft 14 having an impeller 16 at the forward end thereof is mounted in a seal unit 18. A drive unit 20 is detachably secured to the seal unit 18.

The seal unit has a disk shaped flange 22 with a neck 24 which extends into a hole through the vessel cover 12. An O-ring 28 provides a seal. This O-ring surrounds the shaft and is disposed in a notch on the forward (downward) surface of the flange 22. A bushing 30, which is preferably made of low friction material such as polytetrafluoride plastic (Teflon), surrounds the shaft 14 and centers it in the hole 26 in the cover 12 through which the shaft extends. The flange 22 is connected to the cover 12 by stub bolts 34, a plurality of which are spaced from each other along a circular path surrounding the axis 36 of the shaft 14.

A gland plate 38 in the form of a disk has a opening therethrough, with a ring like step 41, and captures a seal seat ring 42. O-rings 44 and 47 seal the seal seat ring. The rearward or upper surface 46 of the seal seat ring is hardened to provide a rotary seal surface. The gland plate 38 is secured to the flange 22 by a plurality of bolts 52. The seal seat ring 42 is a part of a seal assembly 48. This assembly has another part 50. This part is connected to the impeller shaft 14 by set screws 49 and is rotatable with the shaft 14. The part 50 is also connected to translate with the shaft in the direction along the axis 36 of the shaft 14. The seal assembly 40 may be a commercially available mechanical seal. Such seals may be procured from the Durametallic Corporation of Kalamazoo, Michigan, U.S.A.

The seal unit 18 also has a plate 54 having opposite, forward and rearward sides which define surfaces 56 and 58. This plate is a mounting plate. The drive unit 20 is mounted on the surface 58 of the mounting plate 54 by means of four bolts having knurled heads 62. These bolts extend through holes in the mounting plate and are threaded into threaded holes in a support plate 64 of the drive unit 20. The drive unit has, side-by-side each other, a drive motor 66 and a gear reducer 68. The drive motor and reducer are partially contained in a housing 70. The housing has mounted on a wall 72 thereof a speed control 74, a motor on/off switch 75, a motor direction of rotation (forward or reverse) switch (not shown), and an indicator, e.g., a digital read-out meter 76. The meter reads the speed of the motor using a sensor 78 connected to the motor shaft. The controller 74 is a conventional speed control unit, which is connected to the motor 66 and controls the voltage applied to the motor. The motor may be an direct current motor of standard design.

The mounting plate 54 is disposed on posts 80 which space the mounting plate in a direction along the axis of the shaft 36 from the flange 22 and the gland 38. Bolts 82 extending through the plate 54, the posts 80 and into the flange 22 assemble the seal unit 18 together.

The housing 70 of the motor drive unit also captures the reducer 68 and the motor so that they may be assembled together into the drive unit with the support plate 64 by means of nuts and bolts 84.

The top (rearward) part 50 of the seal assembly 48 has a collar 86 which is connected to the impeller shaft 14 by means of the set screws 49 which extend through holes in the collar 86. The collar has guide pins 88 which guide and key a seal ring 90 so that the ring rotates with the collar. Compression springs 92 bias the seal ring downwardly. An O-ring 103 between the collar and the impeller shaft provides a further seal against leakage in the axial direction. Another O-ring or packing 105 between the seal ring 90 and the collar 86 also guards against leaks which might flow through the sealing assembly 40 in the axial direction. The lower or forward end of the seal ring has a carbon ring 94 which engages the hardened surface 46 of the seal seat 42 and provides a rotary seal. A bolt 87 which limits the translation of the collar 86 is screwed into a ring 89 attached to the seal ring 90.

Figure 3:
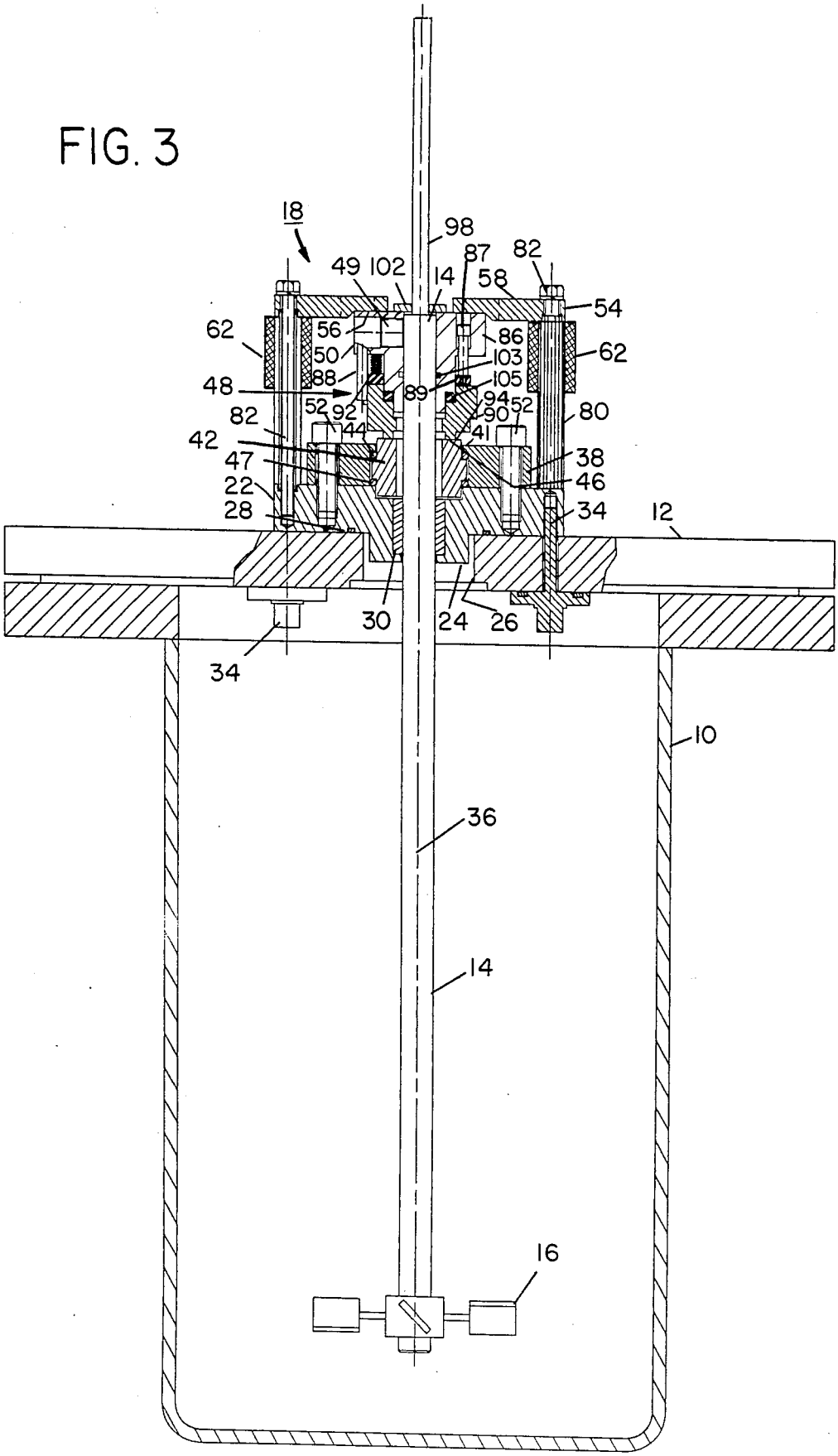
FIG. 3 is a view similar to FIG. 1, but with the drive unit removed from the seal unit.

The gear reducer has a tubular drive shaft 96 which extends, as a sleeve, around a reduced diameter end 98 of the impeller shaft 14. The forward or lower end 100 of the drive shaft engages a washer 102 which may be considered to be a moveable part of the seal assembly 40. The drive shaft 96 locates the moveable part of the seal assembly by translating it axially between the first position as shown in FIG. 3 where the upper end of the collar 86 is biased by the springs 92 so as to bear against the surface 56 of the mounting plate 54. In this position sufficient force is exerted by the seal ring 94 against the heat surface 46 to provide a static seal. Then, the mixing apparatus including the seal unit 18 and the impeller shaft 14 from which the drive unit 20 has been detached may be sterilized alone or with the collar 12 or even together with the collar and the vessel 10.

When the motor drive unit is assembled on the surface 58 of the mounting plate 54 and the knurled bolts 62 are tightened to draw the support plate 64 and the mounting plate 54 together, the forward end 100 of the drive shaft 96 bears upon and translates the collar 86 of the seal assembly part 50 away from the surface 56. Then the shaft and moveable parts 50 of the sealing assembly 40 can rotate freely, and a dynamic seal is provided between the selling ring 94 and the surface 46. The mixer is then in the position shown in FIG. 1.

A collet 106 is mounted on a split ring section 108 at the rear end of the assembled drive and impeller shafts. The collet is threaded onto the outside of the rear end of the drive shaft 96. When the collet 106 is screwed down and tightened, the split ring 108 is compressed so as to clamp the drive shaft to the impeller shaft and maintain the drive shaft in the position shown in FIG. 1 where the dynamic rotary seal is provided between the contacting surfaces 46 of the seat 42 and the ring 94.

From the foregoing description it will be apparent that there has been provided improved mixing apparatus which is capable of being sterilized. Only a single seal is needed to provide for sealing of the impeller shaft during dynamic and static.conditions when a drive unit is attached and detached, respectively, from the mixing apparatus. Variations and modifications of of the hereindescribed mixing apparatus, within the scope of the invention, will undoubtedly suggest themselves to those skilled in the art. Accordingly, the foregoing description should be taken as a illustrative and not in a limiting sense.

I claim:

1. Apparatus for mixing material contained in a vessel which comprises a sealed impeller shaft unit having an impeller shaft which is extendable into said vessel and a motor drive unit which is detachably mounted on said shaft unit, said shaft unit having a seal assembly attached to said shaft, said seal assembly having a part thereof rotatable with said shaft and translatable with said shaft in a direction along the axis of said shaft, means included in said shaft unit for locating said seal assembly part in a first position to provide a static seal when said drive unit is detached from said shaft unit, and means included in said drive unit for locating said seal assembly in a second position axially spaced from said first position to provide a dynamic seal when said drive unit is attached to said seal unit to enable said shaft and seal assembly to rotate freely when mixing said material.

2. The apparatus according to claim 1, whereby said shaft unit has a plate with an opening aligned with said shaft, said plate having a surface defining said first position, means for biasing said part of said seal assembly part in said first position, and said drive unit having a member for engaging said seal assembly part when said drive unit is mounted on said seal unit for translating said seal assembly part against said bias away from and clear of said surface of said plate to locate said seal assembly part in said second position.

3. The apparatus according to claim 2, wherein said plate is a mounting plate and has opposite sides providing said first named surface and another surface, said drive unit being mountable on said another surface.

4. The apparatus according to claim 3, wherein said drive unit has a drive shaft which extends through said opening in said plate into engagement with said seal assembly part for translating said seal assembly part to said second position.

5. The apparatus according to claim 4, wherein said drive shaft has a forward end and a rear end, said forward end extending through said opening in said mounting plate a sufficient distance to engage said seal assembly part and translate it to said second position when said drive unit is mounted on said mounting plate.

6. The apparatus according to claim 5, wherein said impeller shaft extends rearwardly through said mounting plate opening, said drive shaft being a tubular shaft which is disposable around said impeller shaft when said drive unit is mounted on said seal unit, and means for releasably connecting said drive shaft to said impeller shaft.

7. The apparatus according to claim 6, wherein said drive shaft to impeller shaft connecting means comprises a collet threaded connected to said drive shaft around the rear end thereof, a split ring section at the rear end of said drive shaft which is compressed by said collet to clamp said drive shaft to said impeller shaft.

8. The apparatus according to claim 4, wherein said drive unit has a support plate with an opening through which the forward end of said drive shaft extends, said support plate being disposed upon said mounting plate with the openings in said support and mounting plate in alignment and with said drive and impeller shafts in alignment, a plurality of holes in said mounting plate and a plurality of threaded holes in said support plate which are in alignment when said drive and impeller shafts are in alignment, and a plurality of bolts having knurled heads, said bolts extending into said threaded holes and said heads engaging said mounting plate to releasably attach said drive unit to said seal unit.

9. The apparatus according to claim 4, wherein said drive unit has a support plate with an opening through which the forward end of said drive shaft extends, said support plate being disposed upon said mounting plate with the openings in said support and mounting palte in alignment and with said drive and impeller shafts in alignment, said drive unit having a drive motor, a gear reducer having said drive shaft, said drive motor and reducer being mounted side by side on said support plate.

10. The apparatus according to claim 9, wherein said drive unit has a housing, indicator and control means mounted on a wall of said housing, said motor being disposed in said housing, said housing and being connected to said indicator and control means.

11. The apparatus according to claim 2, wherein said seal unit has base plate means, means assembling said base plate means and said mounting plate spaced from each other in said axial direction, an opening in said base plate means through which said impeller shaft extends, said seal assembly having said first named part and a second part with an opening therethrough for said impeller shaft, said second part being fixedly mounted in said base plate means opening and presenting a seal seat, a seal ring on said collar, said seal ring having a seal surface engageable with said seal seat to define with said seat a rotary seal, and said biasing means being spring means between said collar and said seal ring biasing said collar and ring away from each other.

* * * * *